US010293266B2

(12) United States Patent
Wu

(10) Patent No.: US 10,293,266 B2
(45) Date of Patent: May 21, 2019

(54) REMOTE CONTROL FOR A TOY

(71) Applicant: Apex Toys (Shenzhen) Co., Ltd., Shenzhen (CN)

(72) Inventor: Yong Wu, Hubei (CN)

( * ) Notice: Subject to any disclaimer, the term of this patent is extended or adjusted under 35 U.S.C. 154(b) by 173 days.

(21) Appl. No.: 14/143,170

(22) Filed: Dec. 30, 2013

(65) Prior Publication Data

US 2015/0109110 A1 Apr. 23, 2015

(30) Foreign Application Priority Data

Oct. 18, 2013 (CN) ..... 2013 2 0645779 U

(51) Int. Cl.
*G08C 17/02* (2006.01)
*A63H 30/02* (2006.01)

(52) U.S. Cl.
CPC ..... *A63H 30/02* (2013.01)

(58) Field of Classification Search
CPC ..... A63H 30/00; A63H 30/04; A63H 33/007
See application file for complete search history.

(56) References Cited

U.S. PATENT DOCUMENTS 5,530,455 A * 6/1996 Gillick ..... G06F 3/0312 345/156
6,128,006 A * 10/2000 Rosenberg ..... G01C 21/36 345/161
6,457,206 B1 * 10/2002 Judson ..... A47L 11/34 15/320
6,707,443 B2 * 3/2004 Bruneau ..... A63F 13/06 345/156
7,358,963 B2 * 4/2008 Low ..... G06F 3/0317 345/163
7,710,397 B2 * 5/2010 Krah ..... G06F 3/03543 345/163
2002/0054060 A1 * 5/2002 Schena ..... G01D 7/007 715/701
2005/0077155 A1 * 4/2005 Wang ..... A63F 13/06 200/6 A
2005/0110760 A1 * 5/2005 Huang ..... G06F 3/03543 345/163
2005/0186884 A1 * 8/2005 Evans ..... A63H 17/14 446/456
2007/0027959 A1 * 2/2007 Harris ..... G06F 3/0227 709/217

(Continued)

FOREIGN PATENT DOCUMENTS

CN 203154821 U * 8/2013 ..... A63H 30/04

*Primary Examiner* — Hai Phan
(74) *Attorney, Agent, or Firm* — Prakash Nama; Global IP Services, PLLC

(57) ABSTRACT

The invention discloses a remote control for a toy, which comprises a remote control body, wherein the remote control body includes an upper housing and a lower housing which is matched with the upper housing in mounting; a control circuit board is mounted between the upper housing and the lower housing; a wheel is disposed on the upper end of the control circuit board and exposed on the outside of the upper housing; push button jacks are formed on one side of the wheel; push button holes corresponding to the push button jacks are formed on the upper housing; push buttons are mounted in the push button jacks; a circular jack and a light-emitting diode (LED) emitting lamp hole are formed on a head on one side of the wheel of the remote control.

3 Claims, 1 Drawing Sheet

(56) References Cited

U.S. PATENT DOCUMENTS

| | | | | |
|---|---|---|---|---|
| 2007/0132733 | A1* | 6/2007 | Ram | G06F 3/0227 345/163 |
| 2008/0186279 | A1* | 8/2008 | Van Dalen | G06F 3/0338 345/163 |
| 2008/0278448 | A1* | 11/2008 | Nilsagard | G05G 9/053 345/161 |
| 2010/0118211 | A1* | 5/2010 | Carlsgaard | H04N 5/4403 348/734 |
| 2010/0157170 | A1* | 6/2010 | Carlsgaard | H04N 5/4403 348/734 |
| 2010/0238113 | A1* | 9/2010 | Wu | G06F 3/0338 345/163 |
| 2011/0037696 | A1* | 2/2011 | Tang | G06F 3/0338 345/163 |
| 2012/0040616 | A1* | 2/2012 | Brillhart | G06F 3/023 455/41.3 |
| 2012/0161519 | A1* | 6/2012 | Sutarwala | H02J 1/10 307/43 |
| 2013/0278398 | A1* | 10/2013 | Smetanin | A63H 30/04 340/12.52 |
| 2015/0055804 | A1* | 2/2015 | Beklemisev | H04R 3/00 381/119 |

* cited by examiner

REMOTE CONTROL FOR A TOY

FIELD OF THE INVENTION

The invention relates to a remote control for a toy.

BACKGROUND OF THE INVENTION

The traditional remote control for a toy utilizes simple push buttons and an antenna to control a toy aircraft to fly. As the speed can only be slowly adjusted via the common push buttons and the flexibility and the continuity are low, some stunts cannot be completed, and hence players cannot obtain better entertainment. Moreover, as the traditional remote control for the toy mostly adopts the mode of adding batteries, the cost is high and the service life is short.

SUMMARY OF THE INVENTION

The technical problem to be solved by the invention is to provide a remote control for a toy, which utilizes a universal serial bus (USB) to charge the remote control and adopts a wheel button for control.

The invention adopts the technical proposal that: the invention relates to a remote control for a toy, which comprises a remote control body, wherein the remote control body includes an upper housing and a lower housing which is matched with the upper housing in mounting; a control circuit board is mounted between the upper housing and the lower housing; a wheel is disposed on the upper end of the control circuit board and exposed on the outside of the upper housing; push button jacks are formed on one side of the wheel; push button holes corresponding to the push button jacks are formed on the upper housing; push buttons are mounted in the push button jacks; upper ends of the push buttons run through the push button holes and are exposed on the upper housing; a USB plug is formed on one side surface of the control circuit board; and a circular jack and a light-emitting diode (LED) emitting lamp hole are formed on a head on one side of the wheel of the remote control.

As a preferred technical proposal, a USB cover is sleeved on the outside of the USB plug.

As a preferred technical proposal, an accumulator for storing the circuit is disposed on the upper end of the control circuit board; and built-in batteries of the remote control can be charged via a computer and a USB power source.

As a preferred technical proposal, the USB plug and the remote control for the toy are integrally formed, so that not only the remote control of the toy can be achieved but also the toy can be charged via the USB of the body.

As a preferred technical proposal, the forward, backward, left and right control of the toy can be achieved by the forward, backward, left and right tilting remote control of the wheel.

As a preferred technical proposal, a small hole is formed on the top of the remote control body.

The remote control for the toy provided by the invention has the advantages that: in the remote control for a toy, the wheel is used for achieving the acceleration or deceleration of an accelerator; the USB is used for charging the remote control and a toy aircraft; the wheel can be also used as a push button; and a switch is used for switching a sensor to control the direction change of the toy.

BRIEF DESCRIPTION OF THE DRAWINGS

For the convenience of explanation, detailed description will be given to the invention with reference to the preferred embodiments and the accompanying drawings.

DETAILED DESCRIPTION OF THE PREFERRED EMBODIMENTS

Figure 1:
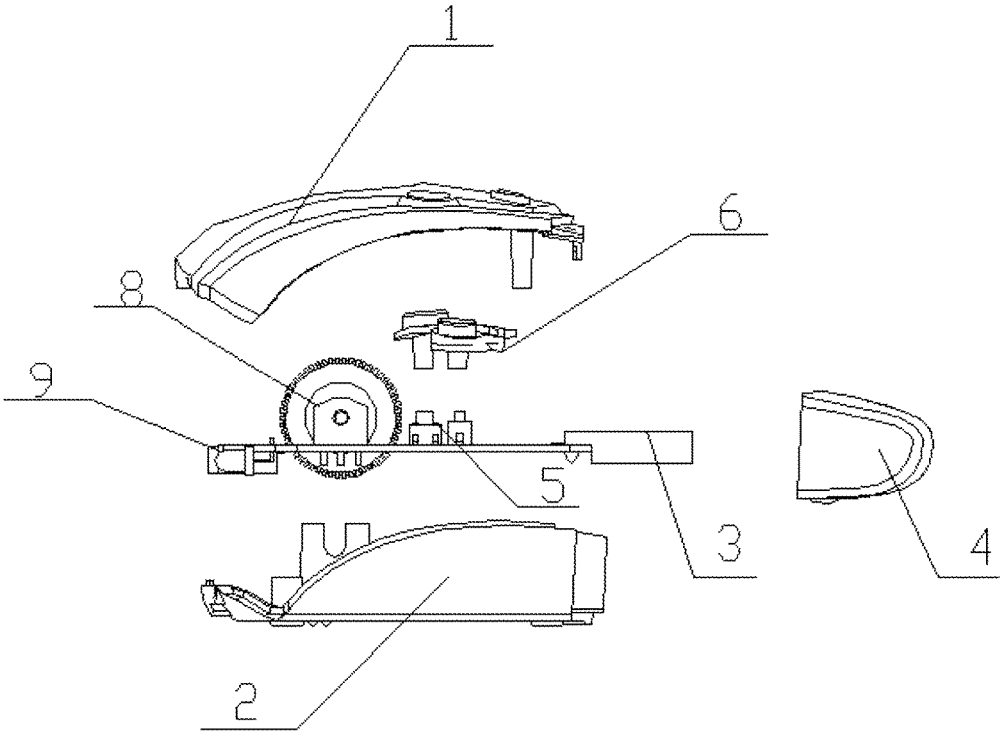
FIG. 1 is an exploded view of the remote control for a toy provided by the invention.
Figure 2:
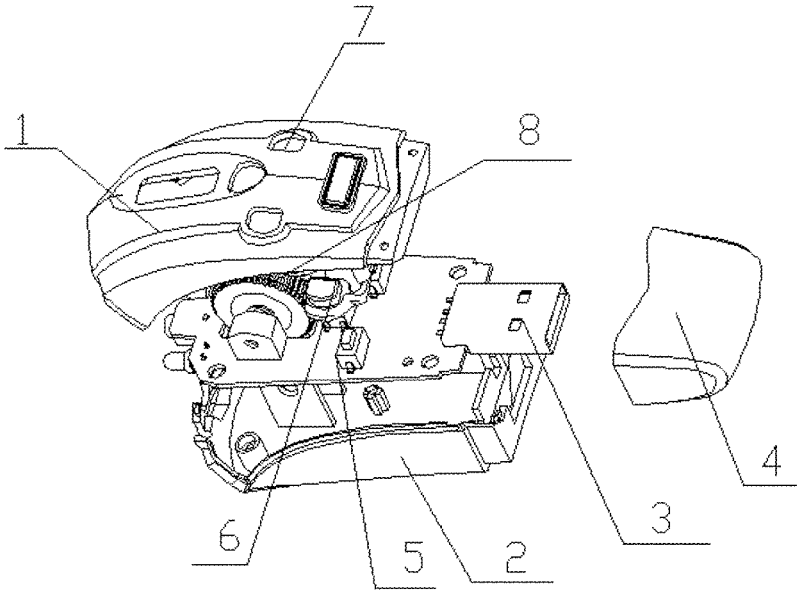
FIG. 2 is another exploded view of the remote control for a toy provided by the invention.

As illustrated in FIGS. 1 and 2, the remote control for a toy provided by the invention comprises a remote control body, wherein the remote control body includes an upper housing 1 and a lower housing 2 which is matched with the upper housing 1 in mounting; a control circuit board 9 is mounted between the upper housing 1 and the lower housing 2; a wheel 8 is disposed on the upper end of the control circuit board 9 and exposed on the outside of the upper housing 1; push button jacks are formed on one side of the wheel 8; push button holes 7 corresponding to the push button jacks are formed on the upper housing 1; push buttons 6 are mounted in the push button jacks 5; upper ends of the push buttons 6 run through the push button holes and are exposed on the upper housing 1; a USB plug 3 is formed on one side surface of the control circuit board 9; and a circular jack and an LED emitting lamp hole are formed on a head on one side of the wheel 8 of the remote control.

As a preferred embodiment, a USB cover 4 is sleeved on the outside of the USB plug 3 and configured to protect the USB plug so that the service life can be prolonged.

In the embodiment, an accumulator for storing the circuit is also disposed on the upper end of the control circuit board.

Wherein, a small hole is formed on the top of the remote control body and configured to connect a data wire for charging built-in batteries of the remote control. Moreover, when the USB plug of the remote control is inserted into a product such as a portable source and a computer, a USB interface on the other end of the data wire led out from the small hole on the top may also be connected to the toy for charging the toy.

Instruction for use: when the wheel is not pressed down, toggling the wheel forward or backward can achieve the acceleration or deceleration of an accelerator; when the wheel is pressed down, a built-in ball will be sensitive to the gravity and the running direction of the toy can be controlled by only tilting the remote control (when the wheel is not pressed down, the wheel only has the single function of acceleration);

when the wheel is toggled slowly forward or backward, the acceleration or deceleration can be correspondingly achieved according to the toggled magnitude (number of grids); and when the wheel is toggled quickly, the remote control will automatically determine whether to achieve the acceleration or deceleration by skipping a grade according to the toggling speed of a controller, and hence the toy can be instantly accelerated or decelerated, which is different from the case that corresponding grids are toggled slowly.

The remote control for the toy provided by the invention has the advantages that: firstly, the remote control utilizes the wheel for achieving the acceleration or deceleration of the accelerator; secondly, as for the charging mode, the remote control utilizes the USB to charge the remote control and the toy simultaneously; thirdly, the accelerator wheel can be also used as a push button; and fourthly, a switch is used for switching a sensor to control the direction change of the toy.

The foregoing is only the preferred embodiments of the invention, but the scope of protection of the invention is not limited thereto. All the changes or replacements made without creative efforts should fall within the scope of protection of the invention. Therefore, the scope of protection of the invention should be defined by the appended claims.

What is claimed is:

1. A remote control for a toy, comprising a remote control body, wherein the remote control body includes an upper housing and a lower housing matched with the upper housing in mounting; a control circuit board is mounted between the upper housing and the lower housing; a wheel is disposed on an upper end of the control circuit board and is exposed on the outside of the upper housing; push button jacks are formed on one side of the wheel; push button holes corresponding to the push button jacks are formed on the upper housing; push buttons are mounted in the push button jacks; upper ends of the push buttons run through the push button holes and are exposed on the upper housing; a universal serial bus (USB) plug is formed on one side surface of the control circuit board, and is formed integrally with the remote control for the toy; and a light-emitting diode (LED) emitting lamp hole is formed on a head on one side of the wheel of the remote control; a hole is formed on a top side of the remote control body and configured to connect one end of a data wire; another end of the data wire is connected to the toy for charging the toy; the wheel comprises a built-in ball sensitive to gravity which allows running direction of the toy to be controlled by tilting the remote control when the wheel is pressed down.

2. The remote control for a toy according to claim 1, wherein an accumulator for storing the circuit is disposed on the upper end of the control circuit board; and built-in batteries of the remote control can be charged via a computer and a USB power source.

3. The remote control for a toy according to claim 1, wherein forward, backward, left and right control of the toy are achieved by tilting the remote control.

* * * * *